US006860172B2

(12) United States Patent
Hecht

(10) Patent No.: US 6,860,172 B2
(45) Date of Patent: Mar. 1, 2005

(54) METHOD FOR MAKING A POWDERED METAL COMPACT

(75) Inventor: Gil Hecht, Nahariya (IL)

(73) Assignee: Iscar, Ltd., Tefen (IL)

( * ) Notice: Subject to any disclaimer, the term of this patent is extended or adjusted under 35 U.S.C. 154(b) by 0 days.

(21) Appl. No.: 10/455,110

(22) Filed: Jun. 4, 2003

(65) Prior Publication Data

US 2004/0035269 A1 Feb. 26, 2004

(30) Foreign Application Priority Data

Jun. 4, 2002 (IL) ..... 150014

(51) Int. Cl.[7] ..... B21K 5/04
(52) U.S. Cl. ..... 76/108.6; 76/108.1; 408/204
(58) Field of Search ..... 76/108.6, 115, 76/108.1; 408/226, 233, 713, 59, 204; 407/11, 53, 54

(56) References Cited

U.S. PATENT DOCUMENTS

| | | | | | |
|---|---|---|---|---|---|
| 3,037,264 | A | * | 6/1962 | Mossberg | 407/11 |
| 3,125,883 | A | * | 3/1964 | Wollner | 73/864.44 |
| 4,322,187 | A | * | 3/1982 | Hougen | 408/204 |
| 5,031,484 | A | * | 7/1991 | Packer | 76/108.6 |
| 5,598,751 | A | * | 2/1997 | Ochayon et al. | 76/108.6 |
| 5,676,499 | A | | 10/1997 | Tukala | 408/59 |

FOREIGN PATENT DOCUMENTS

| | | | | |
|---|---|---|---|---|
| EP | 0352224 | A1 | * | 1/1990 |
| WO | WO03101648 | A1 | * | 12/2003 |

* cited by examiner

*Primary Examiner*—Hwei-Siu Payer
(74) *Attorney, Agent, or Firm*—Womble Carlyle

(57) ABSTRACT

A method for producing a powdered metal compact for a cutting head to be used in a metal cutting tool uses a punch and die assembly. The resulting cutting head has apertures communicating between a coolant channel and recesses.

11 Claims, 3 Drawing Sheets

METHOD FOR MAKING A POWDERED METAL COMPACT

FIELD OF THE INVENTION

This invention relates to cutting tools having internal coolant channels and particularly to cutting tools, or detachable cutting heads for cutting tools, made by form pressing and sintering carbide powders.

BACKGROUND OF THE INVENTION

In many metal working chip forming operations it is desirable to deliver a coolant directly to the working edge. The purpose of the coolant is not only to cool the working edge but also to assist in chip removal. The most straightforward and easiest to manufacture coolant channels are axially directed. This can be done by simply drilling a central bore, or two parallel axially directed bores in the tool. In drills, twisted or helical channels are also used. In drills with replaceable cutting inserts spaced at different radial distances from the axis of rotation it is desirable to direct the exit opening towards the cutting inserts. U.S. Pat. No. 5,676,499 there is described a process wherein straight holes are drilled at different radial distances in a cylindrical blank. The middle portion of the blank is then heated and twisted giving rise to spirally formed channels. At the end of the process exit channels are drilled at an angle to the centerline of the drill resulting in exit openings that are spaced at different radial distances from the centerline, in the vicinity of the cutting inserts.

Another method for obtaining complex shaped coolant channels is to use a core such as copper or wax in a powder body and then sinter. The core can be of any desired shape. During the sintering operation, the core disappears into the pores of the powdered body by infiltration leaving a cavity of configuration corresponding to the shape of the core.

SUMMARY OF THE INVENTION

In accordance with the present invention there is provided a method for producing a powdered metal compact in a punch and die assembly, the powdered metal compact having a bore, at least one recess and at least one aperture communicating between the bore and the at least one recess, the method comprising:

- providing a top punch having a forward end with at least one first protruding member;
- providing a bottom punch having forward end with at least one second protruding member;
- positioning the top and bottom punches in a die with the forward end of the top punch facing the forward end of the bottom punch and with a metal powder therebetween;
- compacting the metal powder by pressing the top and bottom punches towards each other until the at least one first protruding member abuts the least one second protruding member at at least one region of contact, wherein the bore is formed by a volume of space delimited by the at least one second protruding member between the top and bottom punches and the at least one aperture is formed at the at least one region of contact; and
- removing the top punch and ejecting the metal powder compact from the die.

In accordance with a preferred embodiment, the metal powder comprises a cemented carbide and a binder.

Typically, the cemented carbide is tungsten carbide and the binder is cobalt.

If desired, the method comprises an additional step of sintering the metal powder compact.

In accordance with a specific application, the second protruding member is cylindrical, in the form of a rod.

Further, if desired, the method further comprises grinding the sintered metal powder compact.

Preferably, the further additional step of grinding produces cutting edges on a cutting portion of the metal powder compact.

If desired, the further additional step of grinding also produces an external screw thread on a mounting portion of the metal powder compact There is also provided in accordance with the present invention a cutting head for a metal cutting tool comprising a metal powder compact, produced in accordance with the above method.

BRIEF DESCRIPTION OF THE DRAWINGS

For a better understanding the invention will now be described, by way of example only, with reference to the accompanying drawings in which.

DETAILED DESCRIPTION OF THE INVENTION

Figure 1:
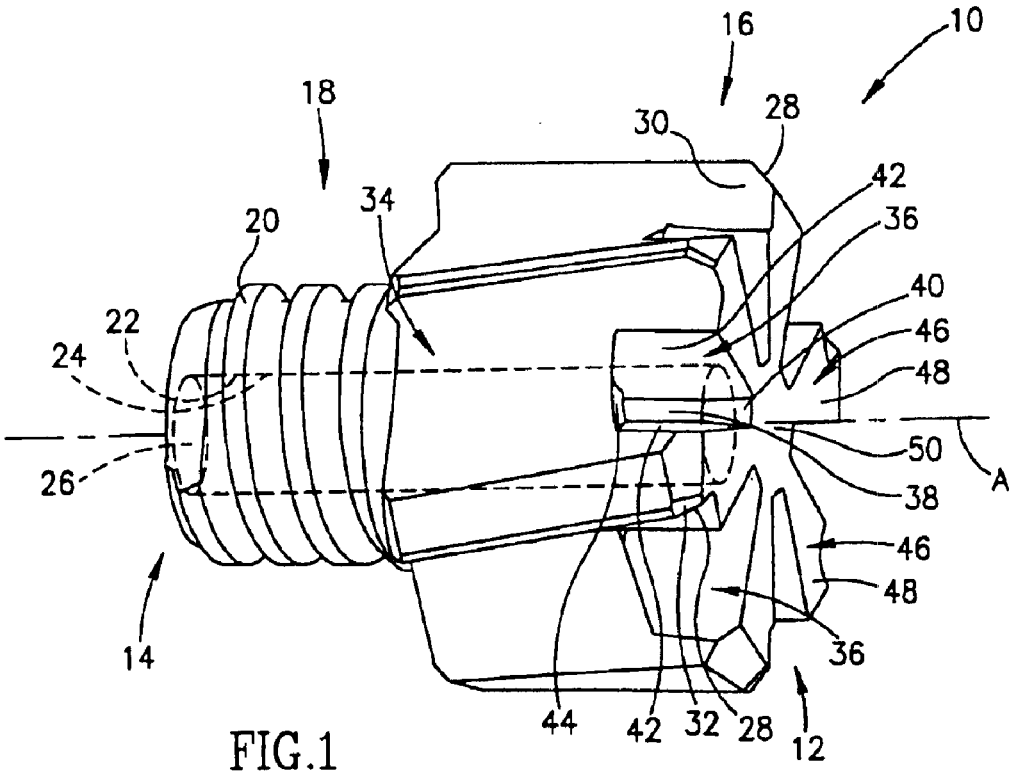
FIG. 1 is a perspective view of a cutting head for a metal cutting tool, produced from a powdered metal compact in accordance with the present invention.

FIG. 1 shows a cutting head 10 for a metal cutting tool. Typically, the cutting tool comprises a tool shank (not shown) to which the cutting head 10 is secured. The cutting head has front and rear ends 12, 14 and a longitudinal axis A passing therethrough. The cutting head 10 comprises a cutting portion 16 formed integrally with a mounting portion 18. The mounting portion 18 is provided with an external screw thread 20. An axially directed bore 22, having a bore surface 24, extends from adjacent the front end 12 to the rear end 14, opening out at the rear end 14 to a bore opening 26. The cutting portion 16 is provided with six cutting edges 28. Each cutting edge 28 is formed at the intersection of rake surface 30 and a relief surface 32. Adjacent each rake surface is a chip gullet 34. Adjacent the front end 12 of the cutting head 10 there is associated with each chip gullet 34 a wedge-like cutting head recess 36 opening out into the chip gullet 34 and into the front end 12 of the cutting head 10. At a radially innermost part of each cutting head recess 36 there is an aperture 38. The aperture 38 is adjacent to, but axially rearwardly displaced from, the front end 12 of the cutting head 10. Each aperture 38 communicates between the cutting head recess 36 and the bore 22 and geometrically coincides with the bore surface 24. The bore 0.22 forms a coolant channel and therefore coolant fluid entering the bore 22 from the bore opening 26 will traverse the bore 22 axially and exit the bore 22 through the apertures 38. Hence the apertures 38 form exit openings of the bore 22 for distributing coolant fluid to the vicinity of the cutting edges 28.

Each wedge-like cutting head recess 36 comprises an inner wall 40, two side walls 42 and a rear wall 44. The inner wall 40 extends from the aperture 38 to the front end 12 of the cutting head 10 and is flush with the aperture 38. The rear wall 44 extends between the two side walls 42 and also extends radially outwardly from the aperture 38. The side walls 42 extend axially from the rear wall 44 to the front end of the cutting head 10, and radially outwardly from the aperture 38 and the inner wall 40. The six wedge-like cutting head recess 36 divide the front end 12 of the cutting head 10 into a symmetrical structure having six identical wedge-like cutting head protrusions 46, with a wedge-like cutting head recess 36 between each pair of adjacent cutting head protrusions 46. Each cutting head protrusion 46 has a front surface 48 coinciding with the front end 12 of the cutting head 10. Since for each cutting head recess the aperture 38 geometrically coincides with the bore surface 24 and since the inner wall 40 extends from the aperture 38 to the front end 12 of the cutting head 10 and is flush with the aperture 38, therefore a circular region 50 is formed at the center of the front end of the cutting head 12. The circular region 50 has a diameter equal to the diameter of the bore 22.

Figure 2:
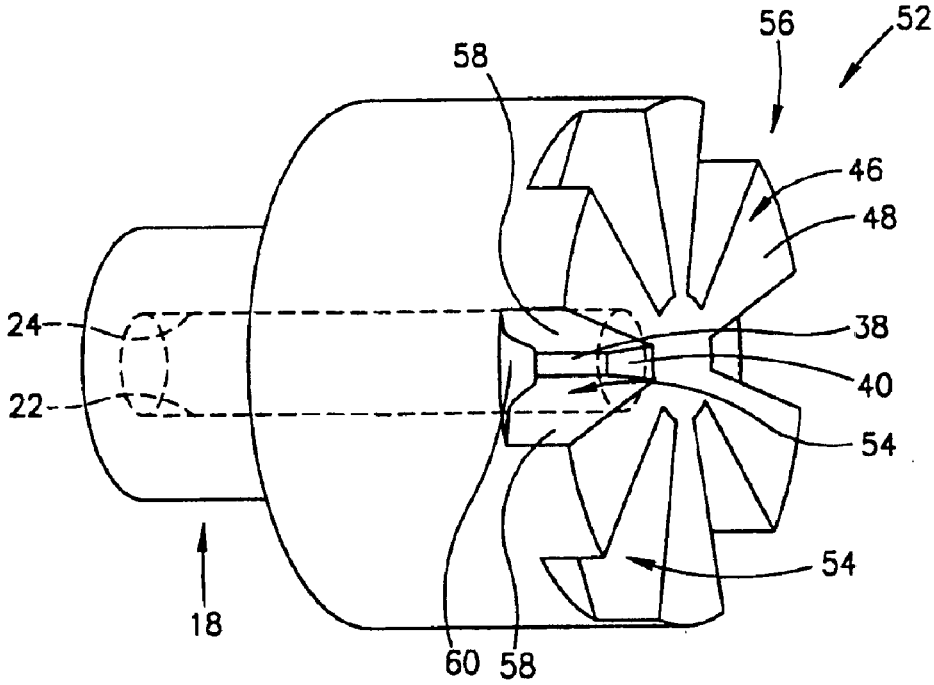
FIG. 2 is a perspective view of a powdered metal compact produced in a punch and die assembly in accordance with the present invention.

In accordance with the present invention the cutting head 10 is produced as an integral body from a powdered metal compact 52 by form pressing and sintering a metal powder. Attention is now drawn to FIG. 2, showing the powdered metal compact 52 obtained by form pressing and sintering a cemented carbide and a binder. Typically, the cemented carbide is tungsten carbide and the binder is cobalt. The cutting head 10 is obtained from the powdered metal compact 52 by suitably grinding the powdered metal compact 52 to produce the chip gullets 34, cutting edges 28 and associated features on the cutting portion 16 and the screw thread 20 on the mounting portion 18.

The powdered metal compact 52 is produced with enlarged recesses 54, relative to the size of the cutting head recesses 36, at its front end 56. Each enlarged recess 54 comprises the inner wall 40 and aperture 38, identical to those of the cutting head recess 36 and enlarged side walls 58 and an enlarged rear wall 60 similar to the side and rear walls 42, 44 of cutting head recess 36, the only difference being that the enlarged side and rear walls 58, 60 extend radially further than the side and rear walls 42, 44 of cutting head recess 36. Each aperture 38 communicates between a given enlarged recess 54 and the bore 22. It will be appreciated by comparing FIGS. 1 and 2 that due to the grinding of the chip gullets 34, a radially outer section of the enlarged recesses 54 will be removed, whereby the cutting head recesses 36 will be obtained.

Figure 3:
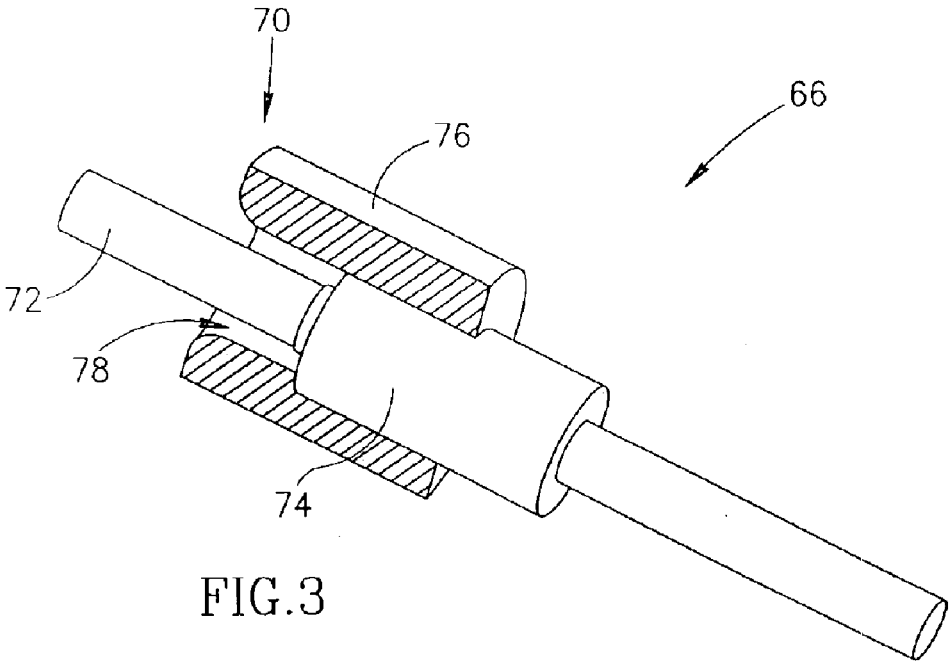
FIG. 3 is a side perspective cross sectional view of a bottom punch in accordance with the present invention.
Figure 4:
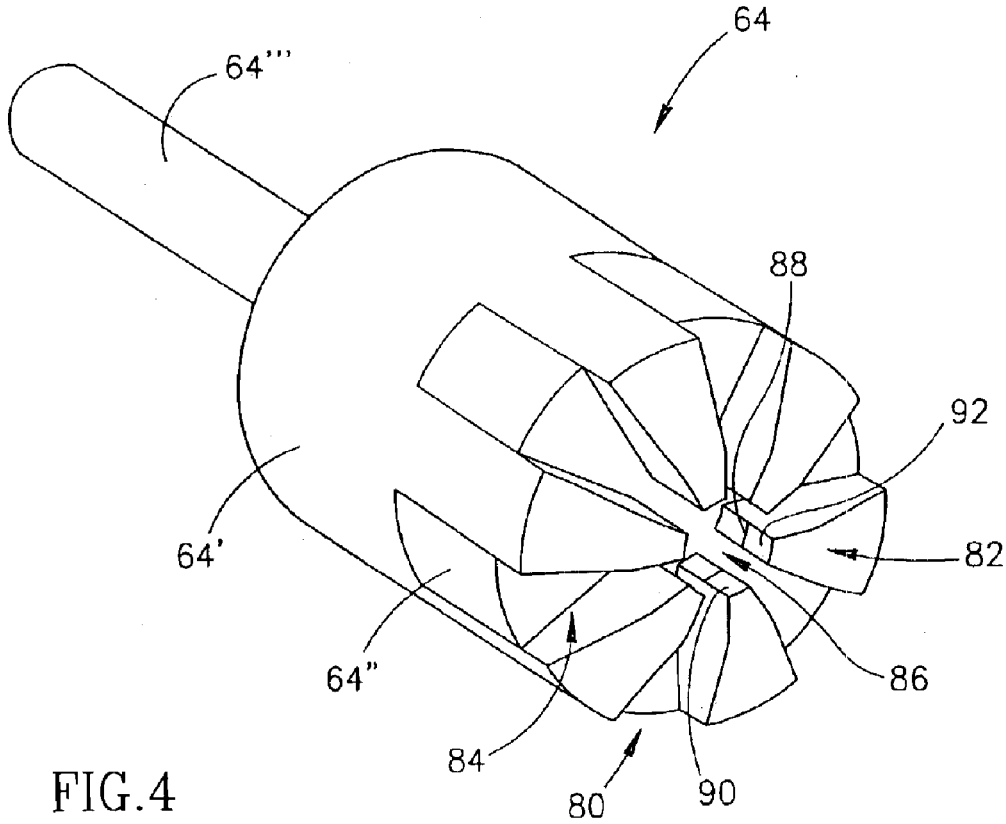
FIG. 4 is a perspective view of a top punch in accordance with the present invention.
Figure 5:
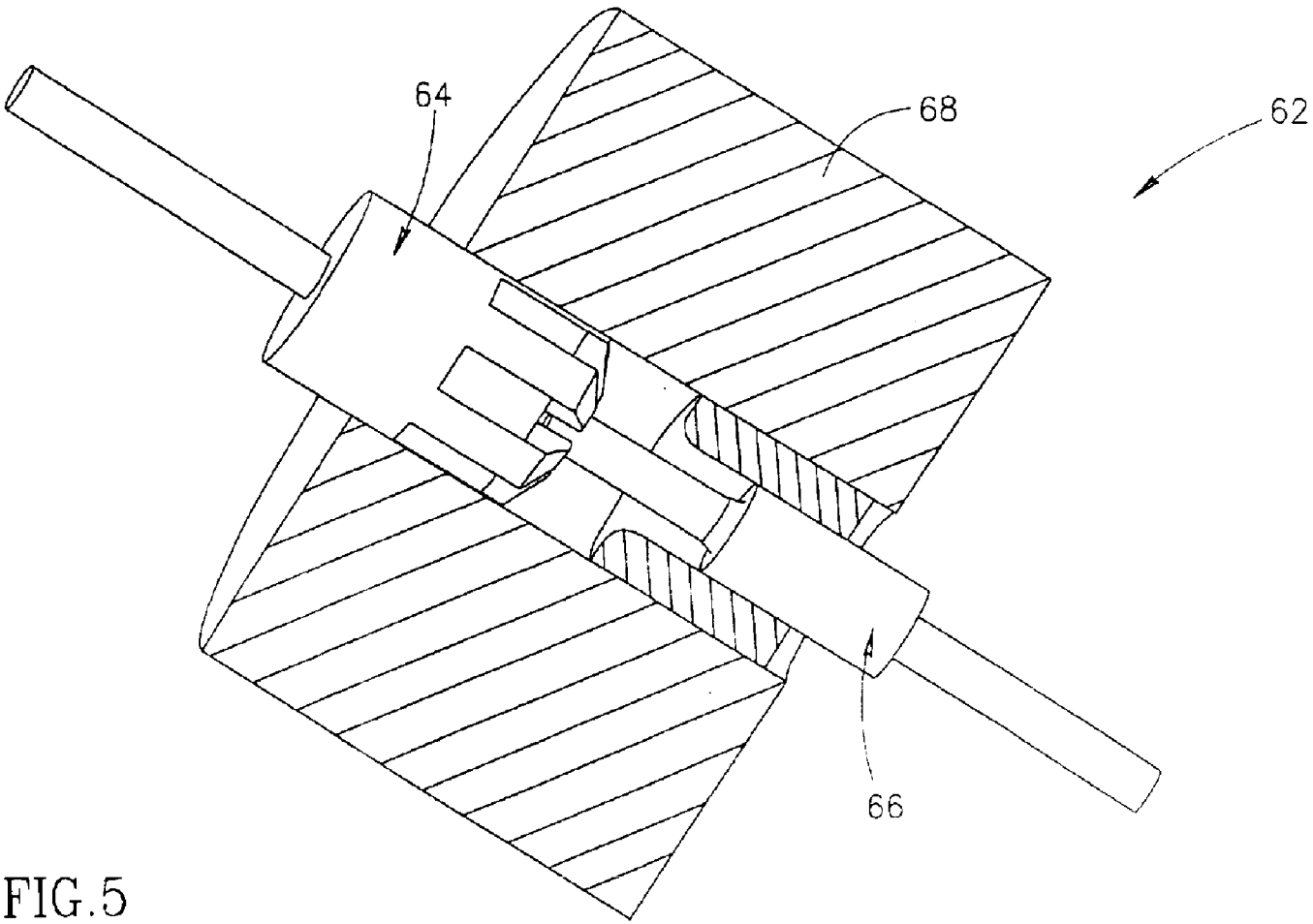
FIG. 5 is a side cross sectional view of a punch and die assembly in accordance with the present invention.

Attention is now drawn to FIGS. 3 to 5. A punch and die assembly 62 comprises a top punch 64 and a bottom punch 66 located in a die 68. The bottom punch 66 has a forward end 70 comprising a central cylindrical rod 72 emanating from a cylindrical base 74 both of which are concentric with a cylindrical shell 76. The cylindrical shell 76 surrounds and abuts the cylindrical base 74 and overlaps a lower part of the rod 72. The region of overlap 78 between the cylindrical shell 76 and the rod 72 defines the geometry of the mounting portion 18, before grinding.

The top punch 64 has a forward end 80 comprising six spaced apart wedge like top punch protrusions 82 separated by top punch recesses 84. The top punch protrusions 82 and the rod 72 form, respectively, first and second protruding members. The geometry of the forward end 80 of the top punch 64 is the negative of the geometry of the front end 56 of the powdered metal compact 52. Hence, when pressing a metal powder between the top and bottom punches, the top punch protrusions 82 will form in the powdered metal compact 52 the enlarged recesses 54, the top punch recesses 84 will form in the powdered metal compact 52 the wedge-like cutting head protrusions 46. A central circular recess 86 in the top punch 64 together with the rod 72 will form the circular region 50 at the center of the front end 56 of the powdered metal compact 52.

As shown in FIG. 5, the rod 72 is located in the central circular recess 86 in the top punch during the pressing of the metal powder. The diameter of the rod 72 is only slightly smaller than the diameter of the central circular recess 86 by generally less than one hundredth of a millimeter and preferably less than about five thousandths of a millimeter. This ensures, on the one hand that the rod 72 can enter the central circular recess 86 and on the other that the top punch protrusions 82 will abut the rod 72. In FIG. 4, a line 88 has been drawn on an inner surface 90 of the top punch protrusions 82 to mark the depth of penetration of the rod 72 into the central circular recess 86. If the depth of penetration is h and the total depth of the central circular recess 86 is H, then the axial height of the aperture 38 will be h and the axial thickness of the circular region 50 at the enter of the front end of the powdered metal compact 52 will be H-h. The region of contact 92 between the rod 72 and the inner surface 90 of a given top punch protrusion 82 is the region between the marked line 88 and the forward end 80 of the top punch 64. The regions of contact 92 define and create the apertures 38 and the volume of space delimited by the rod 72 between the top and bottom punches 64, 66 defines and creates the bore 22. It will be apparent that one or both of the contacting surfaces may be concave in the region of contact. In such a case, instead of a region of contact there will be an equivalent closed line of contact that will define the aperture.

A straightforward method for producing a cutting head 10 for a cutting tool has been described. The method involves using a bottom punch 66 having a protruding rod 72 that creates the bore (coolant channel) 22. A typical aperture (exit opening for the coolant channel) 38 is formed by designing the pressing process in such a way that when the metal powder is compacted a region of contact is created between the rod 72 and the top punch 64. This region of contact will be the typical aperture 38. In other words, a cutting head 10 for a cutting tool can be produced with a coolant channel 22 with exit openings 38 by simply form pressing a metal powder without the use of any ancillary means.

It will be noted that the top punch 64 comprises a first top punch member 64' and a second top punch member 64". The second top punch member 64" is connected to a push rod 64'" which can move freely through a central region of the first top punch member 64'. This is for convenience in order to remove any compacted powder that by chance becomes lodged in the top punch recesses 84.

Although the present invention has been described to a certain degree of particularity, it should be understood that various alterations and modifications can be made without departing from the spirit or scope of the invention as hereinafter claimed.

What is claimed is:

1. A method for producing a powdered metal compact in a punch and die assembly, the powdered metal compact having a bore, at least one recess and at least one aperture communicating between the bore and the at least one recess, the method comprising:

providing a top punch having a forward end with at least one first protruding member;

providing a bottom punch having a forward end with at least one second protruding member;

positioning the top and bottom punches in a die with the forward end of the top punch facing the forward end of the bottom punch and with a metal powder therebetween;

compacting the metal powder by pressing the top and bottom punches towards each other until the at least one first protruding member abuts the at least one second protruding member at at least one region of contact, wherein the bore is formed by a volume of space delimited by the at least one second protruding member between the top and bottom punches and the at least one aperture is formed at the at least one region of contact; and removing the top punch and ejecting the metal powder compact from the die.

2. The method according to claim 1, wherein the metal powder comprises a cemented carbide and a binder.

3. The method according to claim 2, wherein the cemented carbide is tungsten carbide and the binder is cobalt.

4. The method according to claim 1, wherein the second protruding member is cylindrical, in the form of a rod.

5. The method according to claim 1, comprising an additional step of sintering the metal powder compact.

6. The method according to claim 5, comprising a further additional step of grinding the sintered metal powder compact.

7. The method according to claim 6, wherein the further additional step of grinding produces cutting edges on a cutting portion of the metal powder compact.

8. The method according to claim 7, wherein the further additional step of grinding also produces an external screw thread on a mounting portion of the metal powder compact.

9. A cutting head for a metal cutting tool comprising powdered metal compact, produced in accordance with claim 1, the cutting head comprising:

a cutting portion integrally formed with a mounting portion;

an axially directed bore extending from adjacent a front end of the cutting head to a rear end of the cutting head, the front end being associated with the cutting portion and the rear end being associated with the mounting portion;

a plurality of wedge-like cutting head recesses opening out into the front end of the cutting head;

an aperture at a radially innermost part of each cutting head recess, the aperture being adjacent to, but axially rearwardly displaced from, the front end, each aperture communicating between an associated cutting head recess and the bore; and a central circular region formed at the front end of the cutting head, the central circular region and the bore having equal diameters.

10. A method for making a cutting head comprising:

forming a powdered metal compact having a bore, at least one recess and at least one aperture communicating between the bore and the at least one recess, by:

providing a top punch having a forward end with at least one first protruding member;

providing a bottom punch having a forward end with at least one second protruding member;

positioning the top and bottom punches in a die with the forward end of the top punch facing the forward end of the bottom punch and with a metal powder therebetween;

compacting the metal powder by pressing the top and bottom punches towards each other until the at least one first protruding member abuts the at least one second protruding member at at least one region of contact, wherein the bore is formed by a volume of space delimited by the at least one second protruding member between the top and bottom punches and the at least one aperture is formed at the at least one region of contact; and removing the top punch and ejecting the metal powder compact from the die; and grinding said powdered metal compact.

11. A cutting head made in accordance with claim 10, comprising:

a cutting portion integrally formed with a mounting portion;

an axially directed bore extending from adjacent a front end of the cutting head to a rear end of the cutting head, the front end being associated with the cutting portion and the rear end being associated with the mounting portion;

a plurality of wedge-like cutting head recesses opening out into the front end of the cutting head;

an aperture at a radially innermost part of each cutting head recess, the aperture being adjacent to, but axially rearwardly displaced from, the front end, each aperture communicating between an associated cutting head recess and the bore; and a central circular region formed at the front end of the cutting head, the central circular region and the bore having equal diameters.

* * * * *